US006712285B2

(12) United States Patent
Provenaz et al.

(10) Patent No.: US 6,712,285 B2
(45) Date of Patent: Mar. 30, 2004

(54) PROCESS AND STATION FOR CHANGING PRODUCT IN AN INSTALLATION FOR SPRAYING COATING PRODUCT

(75) Inventors: Philippe Provenaz, Grenoble (FR); Stéphane Robert, Meylan (FR); Louis Sentis, Grenoble (FR); Shigeki Fujiwara, Aichi (JP); Takao Ueno, Aichi (JP); Makoto Ichimura, Aichi (JP)

(73) Assignees: Sames Technologies, Meylan (FR); Trinity Industrial Corporation, Aichi (JP)

( * ) Notice: Subject to any disclaimer, the term of this patent is extended or adjusted under 35 U.S.C. 154(b) by 219 days.

(21) Appl. No.: 09/910,871

(22) Filed: Jul. 24, 2001

(65) Prior Publication Data

US 2002/0043567 A1 Apr. 18, 2002

(30) Foreign Application Priority Data

Jul. 24, 2000 (FR) ..... 00 09690

(51) Int. Cl.[7] ..... B05B 17/00

(52) U.S. Cl. ..... 239/1; 238/305; 238/390; 427/477

(58) Field of Search ..... 239/1, 305, 323, 239/390; 901/43; 427/477, 479, 480, 484, 421

(56) References Cited

U.S. PATENT DOCUMENTS 4,944,459 A 7/1990 Watanabe et al.
6,234,405 B1 * 5/2001 Yoshida et al. ..... 239/223
6,391,392 B1 * 5/2002 Thome et al. ..... 427/477
6,439,480 B1 * 8/2002 Velde ..... 239/327
6,458,424 B1 * 10/2002 Yoshida et al. ..... 427/421
6,533,861 B1 * 3/2003 Matsuda et al. ..... 239/223

OTHER PUBLICATIONS

Patent Abstracts of Japan, vol. 009, No. 271 (C–311), Oct. 29 1985.

Patent Abstracts of Japan, vol. 002, No. 093 (C–019), Jul. 29 1978.

* cited by examiner

*Primary Examiner*—Dinh Q. Nguyen
(74) *Attorney, Agent, or Firm*—Browdy and Neimark, P.L.L.C.

(57) ABSTRACT

This station (10) comprises at least two areas (11, 12) for cleaning/filling a reservoir, each adapted to receive a sub-assembly (7) formed by a reservoir (8) and a sprayer (9) while this sub-assembly (7) is disconnected from the robot. A device or devices (51, 52) for cleaning and/or filling the reservoir and/or the sprayer in each of these areas are provided, while these areas (11, 12) are adapted to be brought ($F_2$, $F_3$) into a position of connection of a sub-assembly (7), disposed in one (11) of them with the cleaning and/or filling device or devices (51, 52).

The process consists, inter alia, in positioning ($F_6$) a coating product supply unit (52), in a position of connection with the first sub-assembly (7) received in an area (11) of the station (10) of cleaning/filling.

15 Claims, 9 Drawing Sheets

PROCESS AND STATION FOR CHANGING PRODUCT IN AN INSTALLATION FOR SPRAYING COATING PRODUCT

The invention relates to a process and to a station for changing product in an installation for spraying coating product.

BACKGROUND OF THE INVENTION

It is known, for example from EP-A-0 274 322, to use a reservoir, mounted at the end of an arm of a multi-axis robot, to supply coating product to a pneumatic or rotary sprayer supported by this arm, in particular in the case of an installation for spraying an electrically conducting coating product by means of a sprayer of electrostatic type. This state of the art provides using a sprayer fixed on the arm of the robot, cleaning it and filling it with fresh coating product as a function of needs. According to a first variant, the reservoir is removably mounted on the sprayer and a plurality of reservoirs are used as a function of the coating product chosen. According to a second variant, two reservoirs are used alternately.

BRIEF SUMMARY OF THE INVENTION

In any case, it is necessary to clean the sprayer, which is permanently mounted on the arm of the robot, and prime it with fresh coating product. These operations of rinsing and priming of the sprayer are relatively long, while the time allocated for changing coating product tends to decrease. In effect, in the case of an automobile vehicle production line, the tendency is to increase the production rates or the speeds of advance of the conveyors, which may be of the regularly advancing type or of the "stop and go" type, the coating product being changed in a period of time corresponding to the space separating two consecutive vehicle bodies, the time available being all the shorter as the speed of conveyance increases.

In addition, the losses of coating products during filling of the reservoir and priming of the sprayer should be minimized, as well as the consumption of cleaning product necessary to avoid a mixture and/or pollution between two coating products used successively with the sprayer.

Such consumption should therefore be reduced to a maximum while conserving systems of supply of coating product and of cleaning product which are reliable and of moderate cost.

It is a more particular object of the present invention to overcome these problems and respond to the requirements by proposing a novel process and a novel station for changing coating product, which allow a rapid change of product, while the quality of cleaning effected remains optimum and the consumption of cleaning product and of coating product is substantially reduced with respect to known systems.

To that end, the invention relates to a process for changing product in an installation for spraying coating product, comprising at least one robot, adapted to displace a first sprayer and a first reservoir associated therewith opposite objects to be coated,. This process which includes:

a step of bringing this reservoir towards a suitable area of a cleaning/filling station, a step of separating a first sub-assembly comprising the first reservoir and the first sprayer with respect to the robot, a step of connecting with the robot a second, similar, sub-assembly comprising a second reservoir and a second sprayer, this second sub-assembly being adapted to be used for spraying coating product during cleaning and/or filling of the first reservoir and the first sprayer, and a step of cleaning and/or filling the first reservoir and the first sprayer in the said area;

is characterized in that it comprises the steps of:

positioning a coating product supply unit equipped with a plurality of outlets by displacing this unit in a first direction, so that a predetermined outlet of this unit is disposed opposite the first sub-assembly;

displacing, in a second direction substantially perpendicular to the first direction, a structure defining at least two receiving areas of said sub-assemblies, so as to reach a position of connection of the sub-assembly with said unit.

Thanks to the invention, one can proceed with cleaning the first reservoir and filling it with fresh coating product in masked time. Likewise in masked time, one proceeds with the cleaning of the sprayer and priming thereof with the new coating product, with the result that the only steps of the cleaning/filling process which are to be taken into account in the calculation of the duration of the chance of product are the steps of separation of the first sub-assembly from and of connection of the second sub-assembly on the arm of the robot.

The fact of using a coating product supply unit equipped with a plurality of outlets makes it possible to dispense with the use of a common collector, which would have to be cleaned when two different coating products are successively used, this making it possible to reduce the consumption of products, particularly by the elimination of a pipe between a product change block and the cleaning/filling station. The positioning of this second unit with respect to the sub-assembly also makes it possible to use a single unit of this type for the selective supply of the first or of the second sub-assembly.

According to advantageous aspects of the invention, the process incorporates one or more of the following characteristics:

The operations of separation of the first sub-assembly with respect to the robot and of connection of the second sub-assembly with the robot are carried out within an area of activity of the robot while the operations of positioning the first sub-assembly and the second unit and the operations of connection, of cleaning and/or of filling are carried out outside this area of activity thanks to a movement of the structure in two orthogonal directions. Area of activity is understood to mean the volume in which the arm of the robot is capable of moving.

The process comprises a step consisting of displacing, in the first direction, said structure, so as to place the area of this structure including this sub-assembly opposite a cleaning product supply unit, the displacement of this structure in the second direction making it possible to reach a connection position of the sub-assembly with this cleaning product supply unit. Thus, the positioning of the first sub-assembly opposite the cleaning product supply unit makes it possible to use a single unit for alternately cleaning the first or the second sub-assembly which are each located in a receiving area devoted thereto.

The process consists in connecting at least one of the above-mentioned units to the sub-assembly by displacement of connection means in the second direction.

The process consists in continuously supplying the first sub-assembly with air for forming a bearing and/or with air for driving a turbine of the sprayer as soon as it is deposited in a reception area and until it is withdrawn therefrom. This makes it possible to avoid a risk of "squeezing" an air bearing in the event of sudden rupture of its supply upon disconnection and re-connection of the sub-assembly with respect to the arm of the robot. The fact of permanently supplying a turbine with driving air enables its speed of rotation to be maintained at a value of the same order of magnitude as the speed used for spraying. The time for resumption of speed of the turbine after re-connection of the sub-assembly on the robot arm after the cleaning/filling operation is thus saved. In practice, the turbine of the sprayer of the first sub-assembly is continuously maintained in rotation during the operations of positioning, connection, cleaning and/or filling.

The invention also relates to a product changing station in an installation for spraying coating product, which carries out the process described hereinabove. This station comprises at least two areas for cleaning/filling the reservoir, adapted each to receive a sub-assembly formed by a reservoir and a sprayer while this sub-assembly is disconnected from the robot, means for cleaning and/or filling the reservoir and/or the sprayer in each of these areas being provided. These areas are adapted to be brought into a position of connection of a sub-assembly disposed in one of them with the above-mentioned cleaning and/or filling means, while these means comprise at least one unit mobile in a first direction, provided with a plurality of outlets and adapted to dispose a predetermined outlet of this unit in a position of connection to the sub-assembly.

The mobility of the areas for receiving the sub-assemblies and the second unit makes it possible to reduce the lengths of the pipes supplying cleaning product and/or coating product, i.e. the parts in course of manufacture and the quantities lost upon each change of product. The connection may then take place by the displacement of the appropriate area mentioned above, perpendicularly to the first direction.

According to advantageous aspects of the invention, the station incorporates one or more of the following characteristics:

The areas of reception of sub-assemblies are defined by a structure mobile with respect to a support in a first direction while this support is mobile with respect to the robot in a second direction substantially perpendicular to the first direction.

The cleaning and/or filling means comprise a first unit adapted to deliver to the sub-assembly at least one cleaning fluid, this first unit being disposed opposite the sub-assembly in its position of connection, and a second unit, adapted to deliver to the sub-assembly a predetermined coating product, this second unit being mobile with respect to the first unit. The station therefore allows a positioning of each of the areas of reception of the sub-assemblies opposite the first unit and the second unit with respect to the first unit, in order to allow a connection of each of these units with the sub-assembly received in the area in question. In that case, the second unit advantageously comprises a plurality of modules supplied with coating product and adapted to be selectively connected to the sub-assembly, these modules being juxtaposed in a direction of displacement of the second unit. Thanks to this arrangement, an indexation of the position of the second unit makes it possible to use one or the other of the above-mentioned modules with a view to supplying the sub-assembly with coating product. Certain of these modules may be supplied by means of circuits for circulation of product, for the coating products most often used, while at least one other module is supplied from at least one coating product changing block, for the coating products used least often. In that case, the other module is advantageously provided with means for connection to an element supplied with coating products from the product changing block, this element being mobile in a direction substantially perpendicular to the direction of displacement of the second unit.

The first unit may comprise a connection element applied in the direction of the sub-assembly with a view to their connection.

Means are provided, for supplying air forming a bearing and/or air driving a sprayer turbine of a sub-assembly in place in one or the other of the receiving areas. In that case, a sensor for detecting the presence of a sub-assembly in each of the areas is advantageously used.

The invention will be more readily understood and other advantages thereof will appear more clearly on reading the following description of an embodiment of a product change station and of its process of implementation according to the invention, given solely by way of example and made with reference to the accompanying drawings, in which:

DETAILED DESCRIPTION OF THE INVENTION

Figure 1:
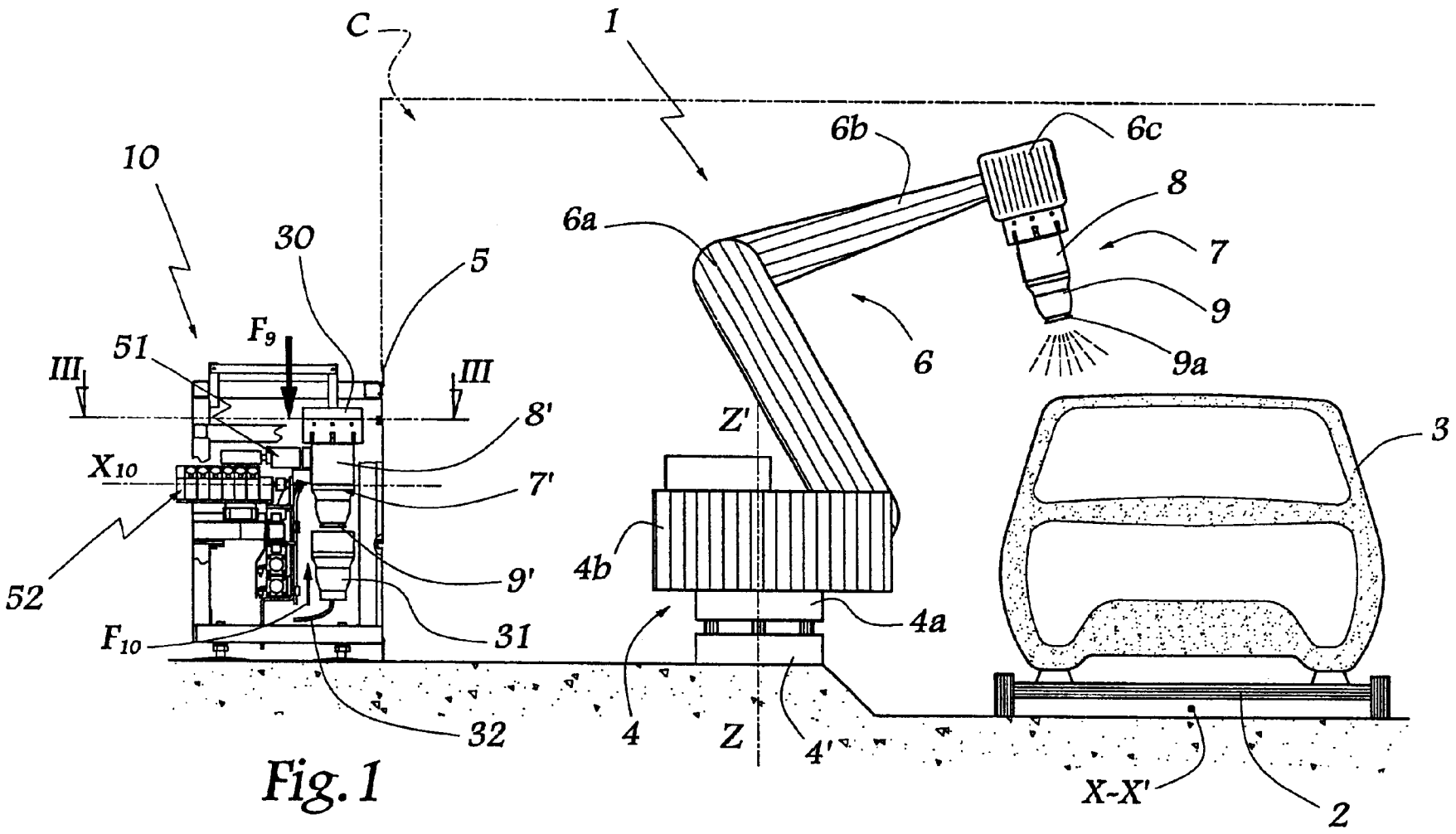
FIG. 1 schematically shows an installation for spraying coating product, incorporating a station according to the invention, during operation.

In FIG. 1, an automat or robot 1 is disposed near a conveyor 2 conveying objects to be coated, in the present case bodies 3 of automobile vehicles. The robot 1 is of the multi-axis type and comprises a chassis 4 mobile on a guide 4' extending parallel to the direction of conveyance X—X'. In order to avoid soiling the guide 4', the latter may be located at a distance from the conveyor 2, the robot 1 in that case being offset with respect to this guide.

A partition 5 of a booth C extends near the robot 1 parallel to direction X—X'. An arm 6 is supported by the chassis 4 and comprises a plurality of segments 6*a*, 6*b* and 6*c* articulated with respect to one another. The chassis 4 is also constituted by parts 4*a* and 4*b* articulated with respect to each other about a substantially vertical axis Z.

The segment 6*c* of arm 6 supports a sub-assembly 7 in which are provided a reservoir 8 of coating product and a sprayer 9. The sprayer 9 is of the electrostatic and rotary type and it bears a bowl 9*a* intended to be driven at high speed by an air turbine 9*c* provided in the body of the sprayer 9.

When an automobile vehicle body 3 is in place at the level of the robot 1, the sub-assembly 7 is displaced opposite the body and the sprayer 9 is activated in order to coat this body with the product contained in the reservoir 8. The quantity of product present in the reservoir 8 is adapted to the surface of the body 3 to be coated.

Figure 2:
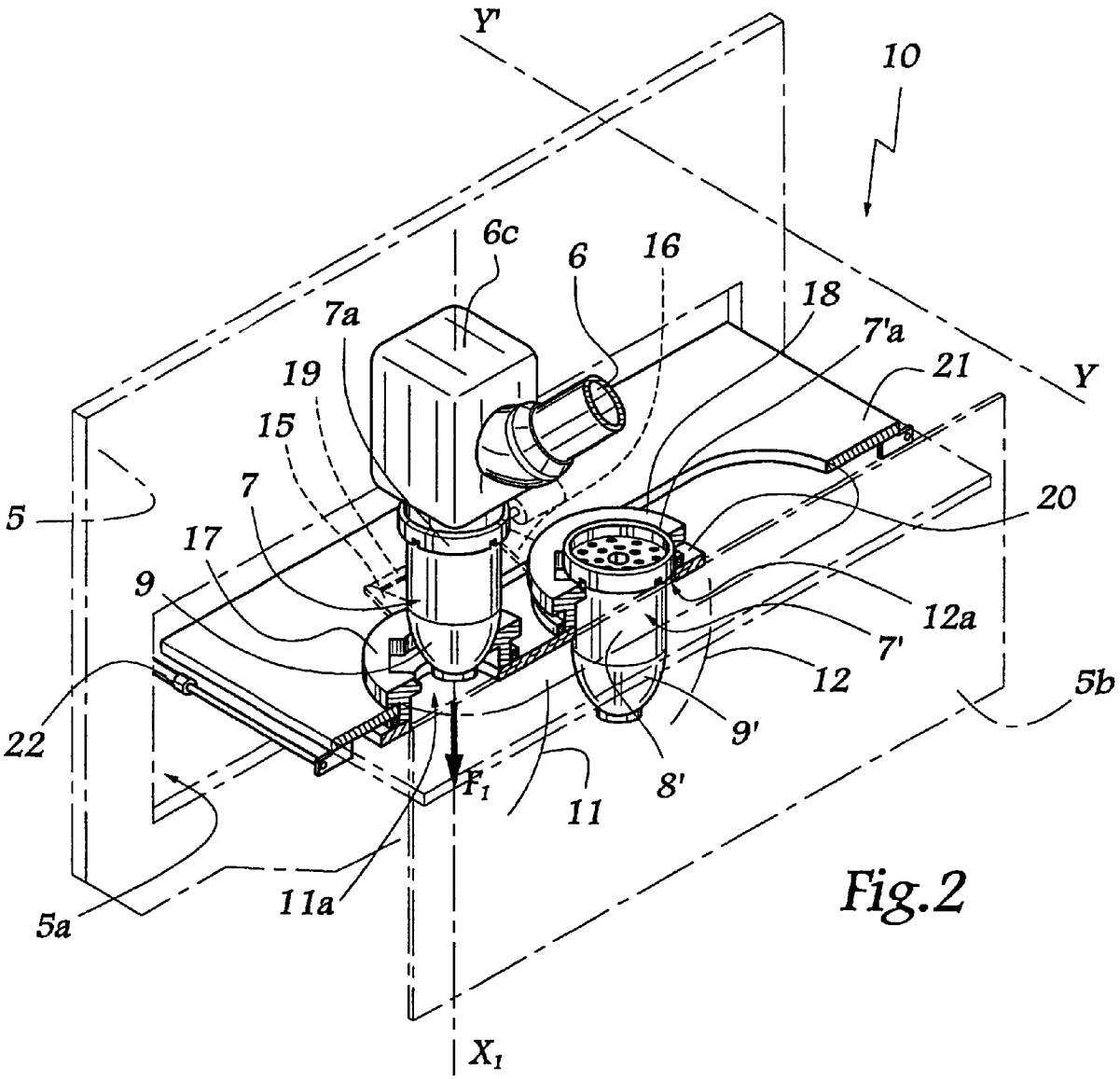
FIG. 2 is a partial perspective view, with parts torn away, of a part of the product change station and of a part of a robot of the installation of FIG. 1, during a first step of the process of the invention.

When a body has been coated, and while a second body is advancing towards the robot 1, the latter is oriented, as shown in FIG. 2, towards a cleaning/filling station 10 located in the vicinity thereof, partially inside the booth and partially outside it.

As is more clearly visible in FIG. 2, this station 10 is provided with two areas 11 and 12 for receiving sub-assemblies of the type such as sub-assembly 7. More precisely, area 11 is empty and ready to receive sub-assembly 7, while area 12 contains a similar sub-assembly 7' which comprises a reservoir 8' and a sprayer 9' similar to those of the sub-assembly 7. The sub-assemblies 7 and 7' may be alternately mounted on the segment 6*c* of the arm 6, as will be explained hereinbelow.

In the step of the process shown in FIG. 2, the arm 6 is in a phase of approach in which it brings the sub-assembly 7 above the area 11 of the station 10. From the position shown in FIG. 2, the arm 6 imparts to sub-assembly 7 a vertical descending movement represented by arrow $F_1$, which makes it possible to bring sub-assembly 7 into area 11. A configuration is thus attained in which a jack 13 controls a rod 14 fast with two connecting rods 15 and 16 connected by a synchronism bar 19 and fast with rings 17 and 18 disposed respectively around the openings 11*a* and 11*b* of areas 11 and 12. In fact, areas 11 and 12 are formed by the volumes accessible from above through openings 11*a* and 12*a*.

The sub-assembly 7 is mounted on the segment 6*c* of the arm 6 thanks to a ring 7*a* capable of a movement of rotation about axis $X_1$ of the sub-assembly 7, this movement being able to be imparted to the ring 7*a* by cooperation of shapes with corresponding elements in relief provided in the ring 17.

Figure 3:
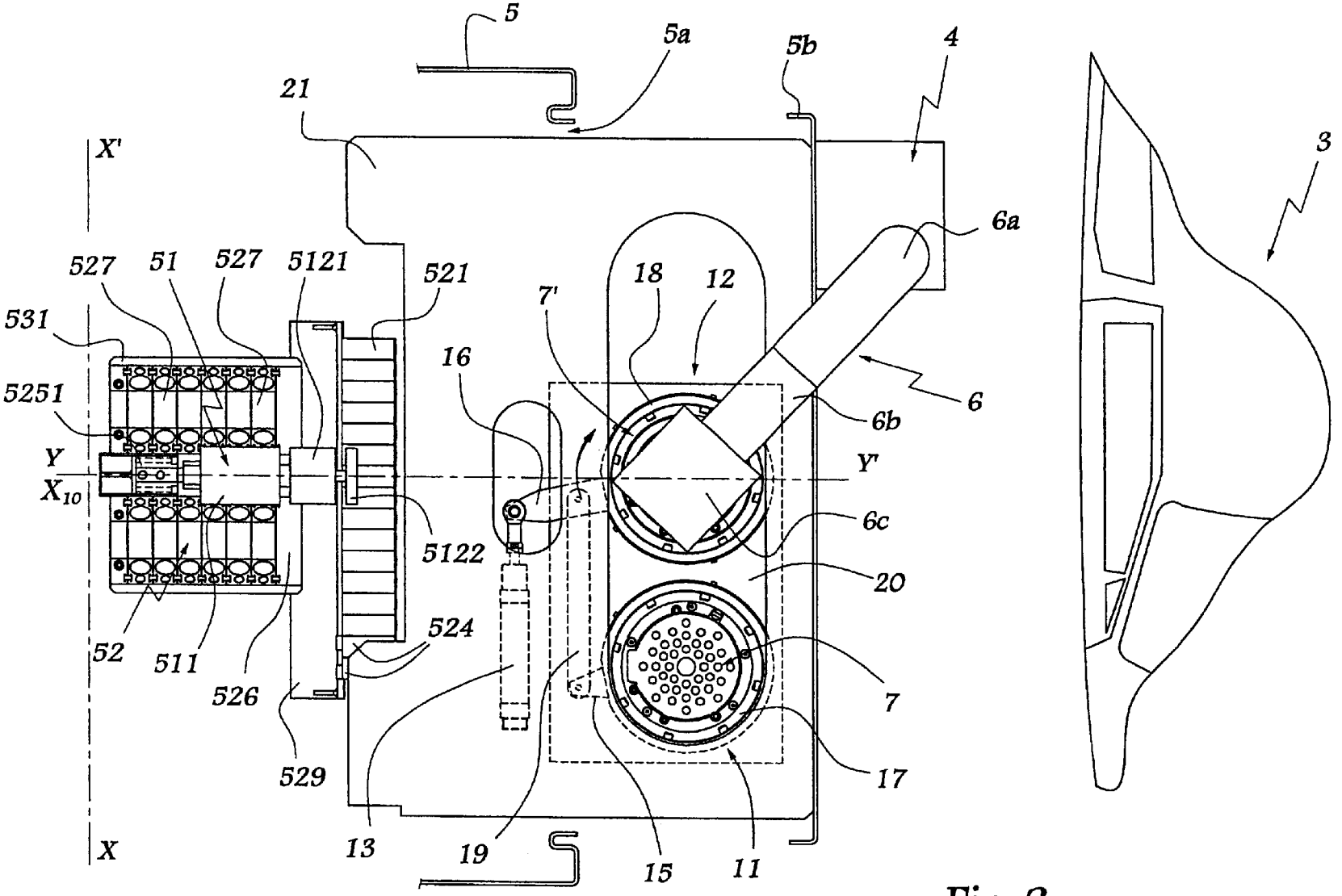
FIG. 3 is a section along line III—III in FIG. 1, during a second step of the process of the invention.

It is thus possible to disconnect the sub-assembly 7 from segment 6*c*, the robot 1 then being in a position to displace this segment up to the level of sub-assembly 7' where a new movement of rotation of the ring 18 controlled by the jack 13 allows a ring 7'*a* of the sub-assembly 7' to be controlled in order to connect the sub-assembly 7' with the segment 6*c*. One is then in the configuration of FIG. 3.

Figure 4:
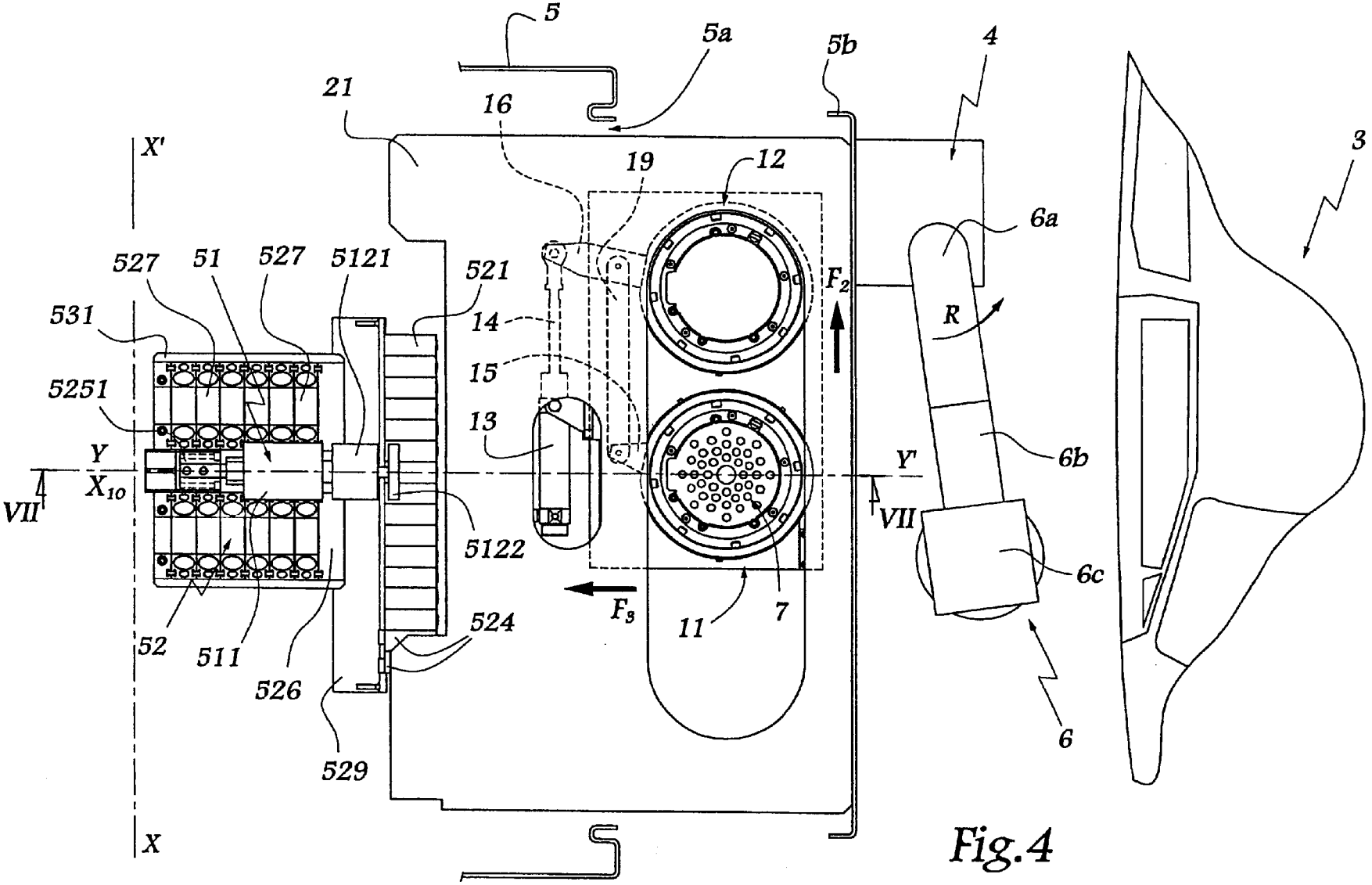
FIG. 4 is a view similar to FIG. 3 during a subsequent step of the process of the invention.

The robot 1 is then in a position to extract the sub-assembly 7' from the area 12 in order to proceed with the coating of a new body, as shown in FIG. 4.

While the robot is coating the body 3 thanks to sub-assembly 7', it is possible to proceed, in masked time, with the cleaning of the sub-assembly 7 and with filling it with fresh coating product. This operation starts as soon as the robot 1 rotates (R) in the direction of body 3.

To that end, a carriage 20 in which areas 11 and 12 are arranged, is mounted on a table 21, the carriage 20 being mobile with respect to the table 21 parallel to axis X—X', as represented by arrow $F_2$. This makes it possible to pass carriage 20 from the position of FIG. 3 to that of FIG. 4, so that area 11 containing the sub-assembly 7 is brought to the level of a median axis $X_{10}$ of the station 10, i.e. opposite a unit 51 for supplying the sub-assembly 7 with cleaning product and with air. Unit 51 is disposed on the median axis $X_{10}$ of the station 10 and the movements of the carriage 20 parallel to direction X—X' may be effected in the direction of arrow $F_2$ or in the opposite direction, so that the areas 11 and 12 may be selectively brought opposite unit 51.

In other words, as a function of the presence or absence of a sub-assembly of the type such as sub-assembly 7 in one or the other of areas 11 and 12, it is possible to bring area 11 or 12, in which this sub-assembly is present, opposite unit 51.

From the position of FIG. 4, the table 21 is displaced, in a direction Y—Y' substantially perpendicular to direction X—X' and in the sense of moving away with respect to conveyor 2, as represented by arrow $F_3$. Table 21 displaces carriage 20 in the direction of arrow $F_3$ and then attains the position of FIG. 5 where the sub-assembly 7 is in abutment against unit 51, which allows a fluid connection between these two elements. In this position, the table 21 and the elements that it supports are out of range of the robot 1, i.e. outside its area of activity.

The table 21 passes through the partition 5 through an opening 5*a* which is then obturated by a panel 5*b* fixed on the edge of the table 21 oriented towards the robot 1. A jack 22 makes it possible to control the displacement of the table 21 in the direction of arrow $F_3$ and in opposite direction.

Figure 5:
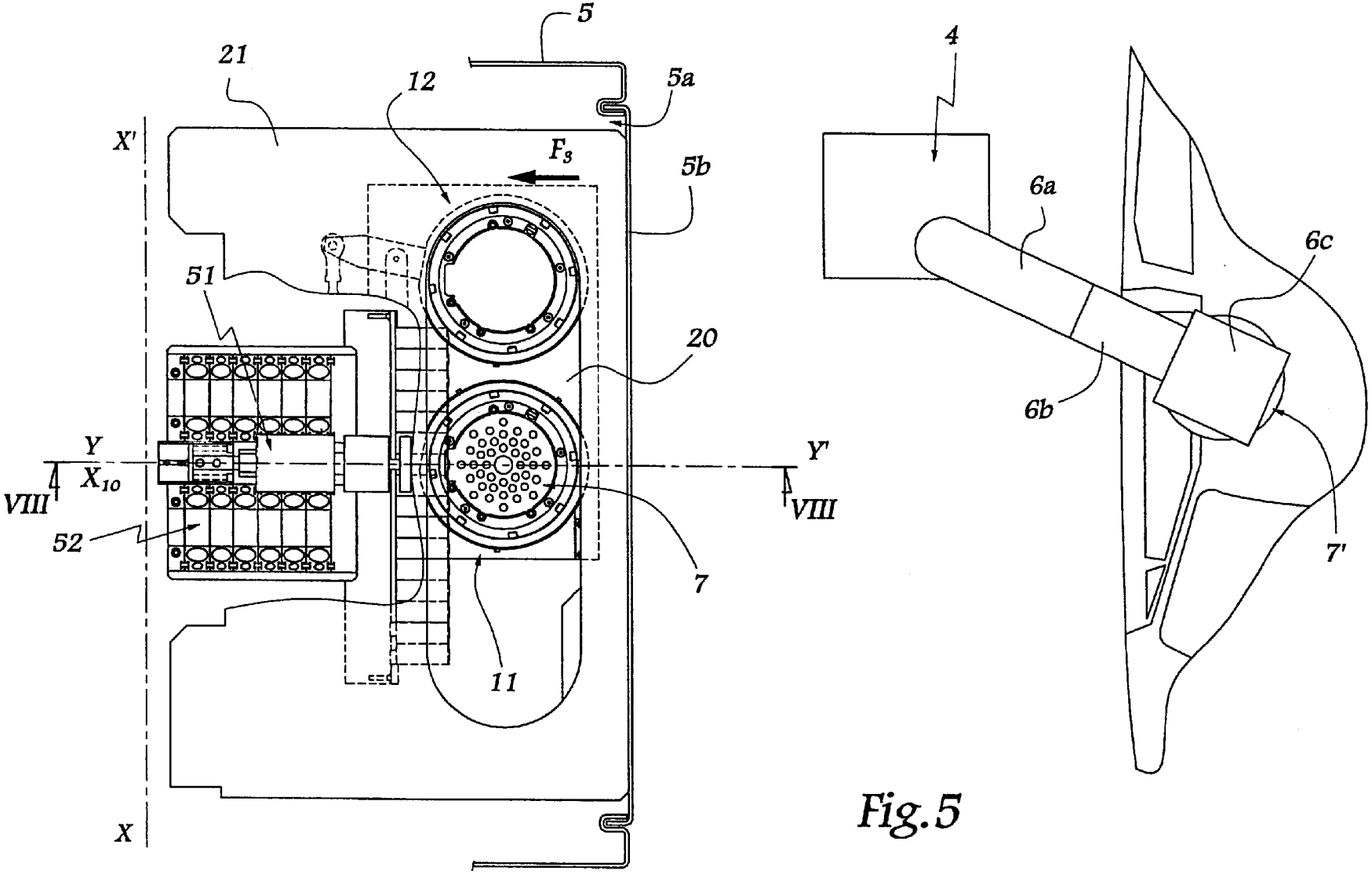
FIG. 5 is a view similar to FIG. 3, with parts torn away, during a second subsequent step of the process of the invention.

When the table 21 is disposed outside the booth, the opening 5*a* is masked by the panel 5*b*, as shown in FIG. 5, and it is possible to proceed with cleaning and filling of the sub-assembly 7, being insulated with respect to the atmosphere of the internal volume of the booth.

Figure 6:
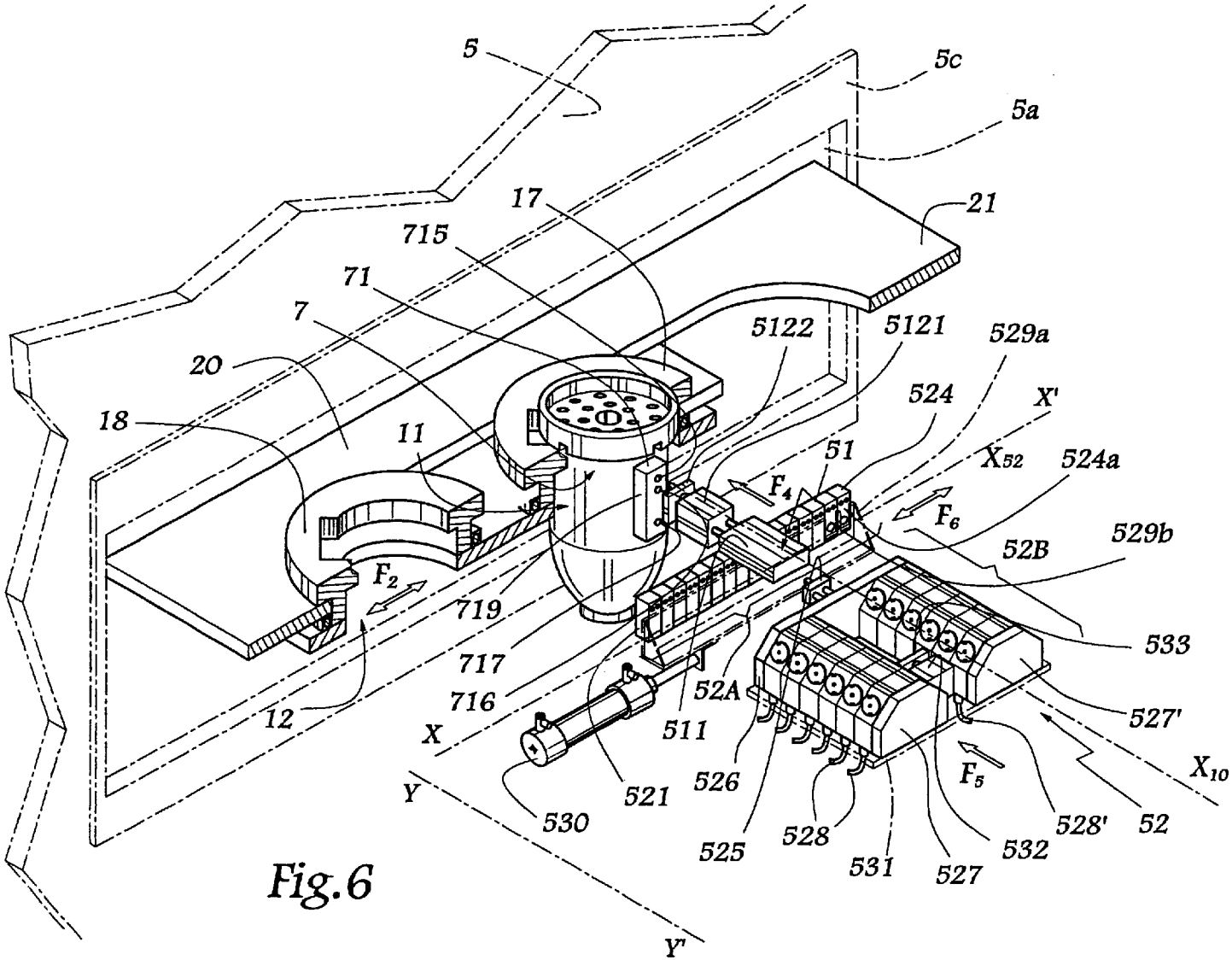
FIG. 6 is an exploded view in perspective, from the rear with respect to FIG. 2, of certain principal elements constituting the product change station, during a subsequent step of the process.
Figure 7:
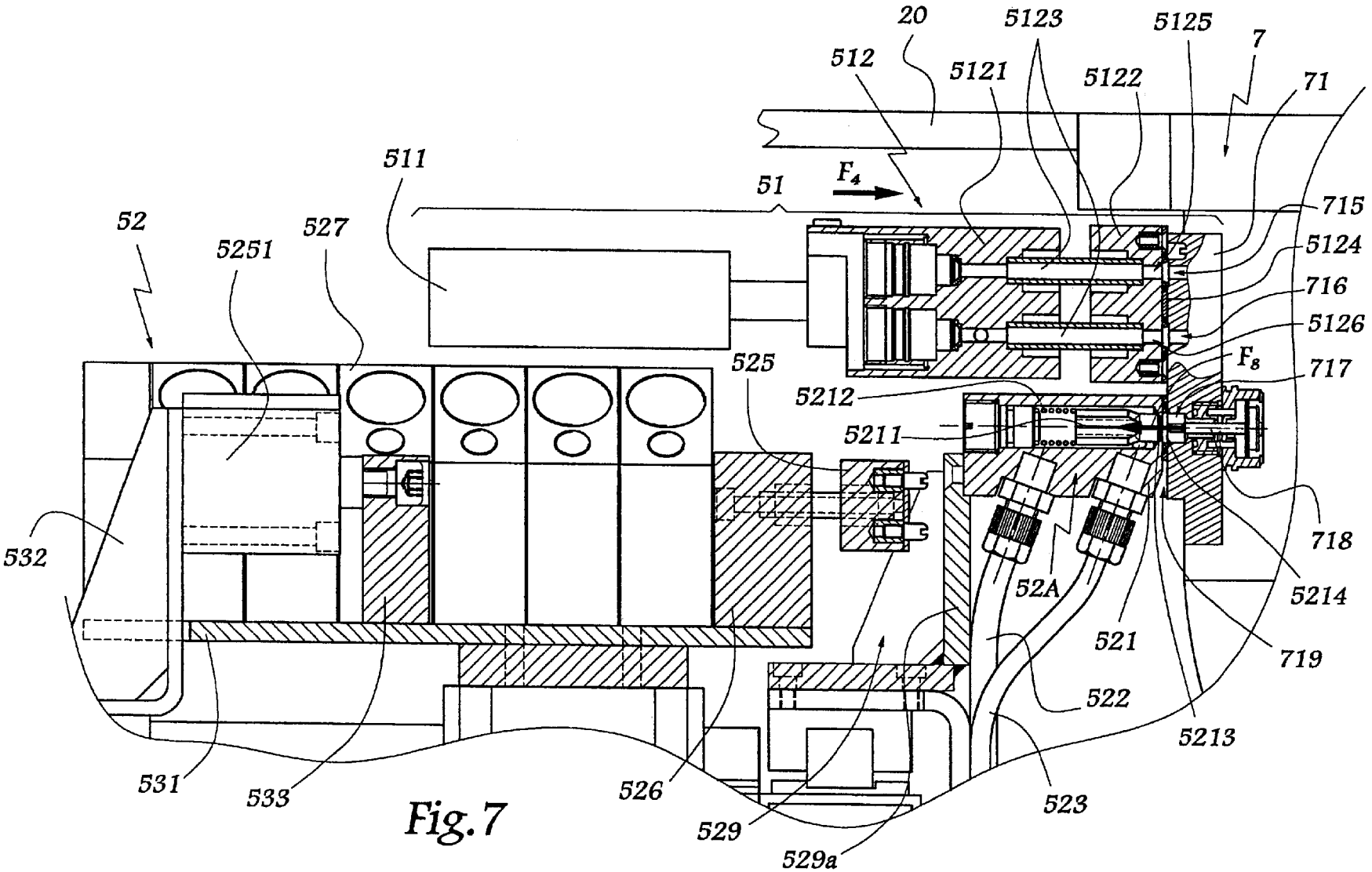
FIG. 7 is a section on a larger scale along line VII—VII of FIG. 5.

The unit 51 comprises a jack 511 and a part 512 applied by the jack 511 in a direction parallel to direction Y—Y', as represented by arrow $F_4$ in FIGS. 6 and 7. Jack 511 is supplied at constant pressure, which allows it to serve as damper of the movement of approach of the table 20 in the direction of arrow $F_3$ and to ensure tightness of the link between elements 7 and 512. In place of the jack 511, a damper made of foam may be used for applying the part 512 towards the sub-assembly 7.

Part 512 comprises a principal body 5121 and an annex body 5122 connected by two conduits 5123 for circulation of cleaning liquid and air. The body 5122 is provided with means for connection with a plate 71 formed on one side of the sub-assembly 7 oriented towards the unit 51.

Figure 8:
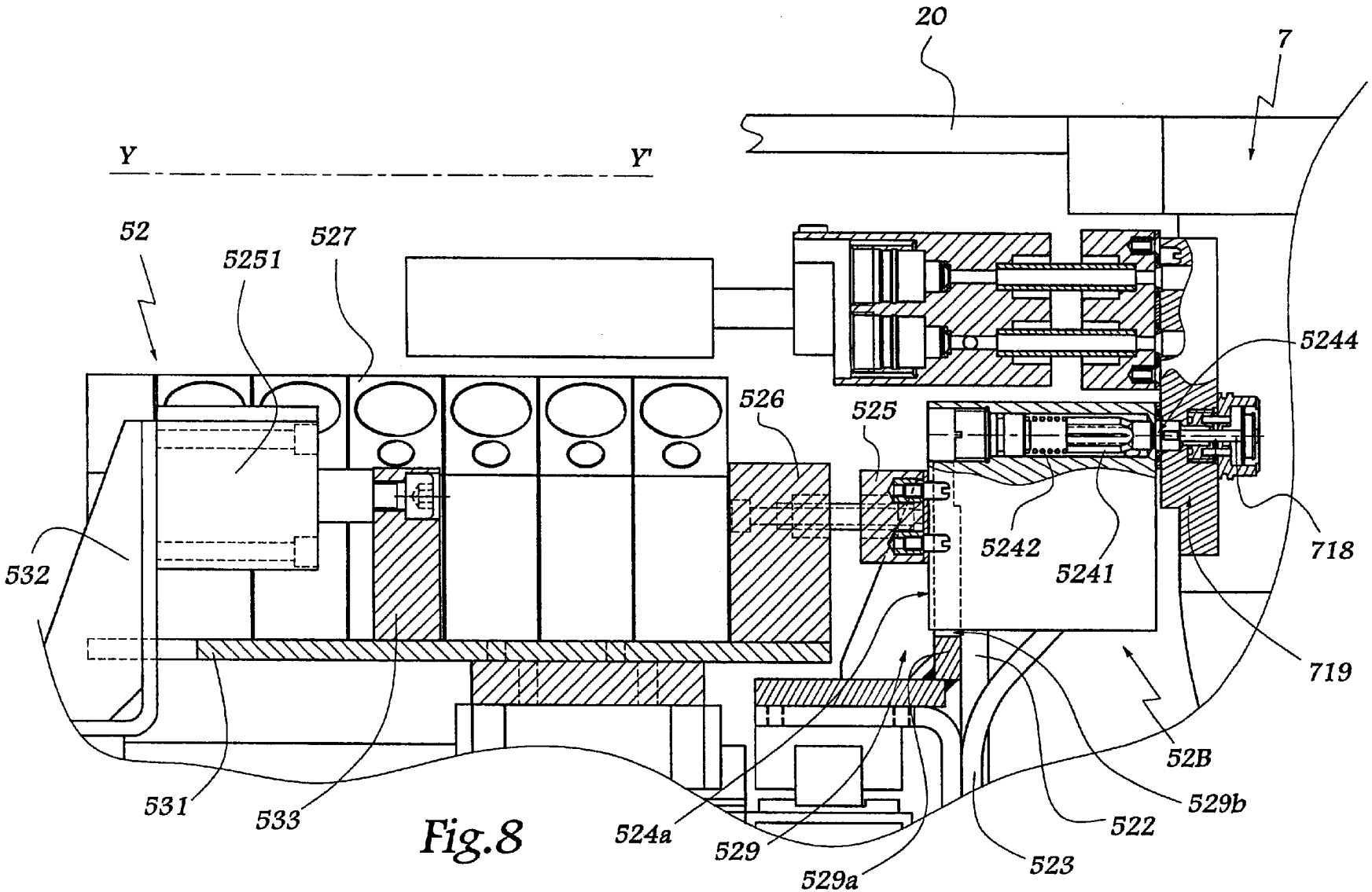
FIG. 8 is a section similar to FIG. 7 during filling of the reservoir of a sub-assembly with a rarely used coating product, and FIG. 9 schematically shows the fluid connections used in the station of the invention.

As is more particularly visible in FIGS. 6 and 8, the unit 51 comprises four electrovalves 5131, 5132, 5133 and 5134 respectively controlling the supply of the sub-assembly 7 with cleaning product for hydrosoluble coating product, with cleaning product for solvented coating product, with air and, for electrovalve 5134, the communication of part 512 with a bleed 514.

Unit 51 is supplied with cleaning product and with air and connected to bleed 514 by supple conduits 515 which, in order to render the drawings clearer, are only shown in FIG. 8.

On its front face 5124, i.e. its face oriented towards the plate 71, the part 512 is provided with two orifices 5125 and 5126 intended to come respectively opposite two orifices 715 and 716 made in the plate 71. When the body 5122 of the part 512 is in abutment against the plate 71, the orifices 5125 and 715 allow a circulation of a mixture of cleaning product and of coating product in the direction of the bleed 514 while orifices 5126 and 716 allow a circulation of solvent or of air/solvent trains from unit 51 towards the interior of the sub-assembly 7.

Before the above-described displacement of the table 21 and of the sub-assembly 7 towards unit 51, a second unit 52 is positioned for supplying the sub-assembly 7 with fresh coating product.

Unit 52 comprises a succession of modules 521 juxtaposed in a direction $X_{52}$ parallel to the direction X—X'. Modules 521 are of two types. A plurality of modules, for example fourteen, are each connected by two conduits 522 and 523 to a device (not shown) for circulation of coating product of a predetermined colour. These modules 521 are thus inserted in a loop for circulating coating product comprising conduits 522 and 523, this construction being used for the coating products most currently used. 52A denotes that part of the unit 52 formed by modules 521.

Unit 52 also comprises two modules 524 which are not connected to conduits of the type such as conduits 522 and 523, but of which one, so-called rear face 524*a* is provided with means for connection with a connector 525 forming the downstream end of a collector 526 of an assembly of two coating product change blocks 527, 527'. Elements 525 to 527 are mobile in direction Y—Y', as represented by arrow $F_5$, being controlled by a jack 5251. 52B denotes that part of unit 52 formed by elements 524 to 527.

Blocks 527 and 527' are connected by bundles of conduits 528 and 528' to sources of coating products used less often than the coating products circulating via conduits 522 and 523. The coating products delivered to blocks 527 and 527' may therefore be considered as "rare shades", as opposed to the "current shades" circulating in conduits 522 and 523. Part 52A is therefore devoted to current shades, while part 52B is devoted to rare shades.

As a function of the shade of the coating product having to be supplied to sub-assembly 7 to fill it, a mobile part 529 of the unit 52 is displaced parallel to direction $X_{52}$, as represented by arrow $F_6$ in FIG. 6, so that, in the case of a current shade, a module 521 of part 52A supplied with the preselected product is disposed opposite an orifice 717 for introducing coating product into the sub-assembly 7.

As is more particularly visible in FIG. 7, each module 521 comprises a valve 5211 elastically loaded by a spring 5212 in the direction of a seat 5213. A closed valve by default is thus formed. The orifice 717 of the plate 71 allows passage of an actuator 718 fast with a piston whose displacement is controlled inside the sub-assembly 7 by any appropriate means, for example pneumatically.

In this way, when the block 521 corresponding to the product to be used for filling the reservoir 8 of the sub-assembly 7 is in abutment against a lower part 719 of the plate 71, the actuator 718 may traverse the orifice 717 and the outlet orifice 5214 of the module 521 so as to push the valve 5211 against the effort of spring 5212, as represented by arrow $F_8$ in FIG. 7, which allows a circulation of the coating product from module 521 towards the interior of the sub-assembly 7.

When a rare shade is to be used, part 529 is displaced in the direction of arrow $F_6$, so that one of the modules 524 of part 52B is brought opposite the plate 71 and the mobile connector 525 which are then substantially aligned on the median axis $X_{10}$ of the station 10. It is then possible to displace the connector 525, the collector 526 and the blocks 527 and 527' in the direction of module 524 as represented by arrow $F_5$ in FIGS. 6 and 8.

The connector 525 is supplied by the collector 526 with the coating product to be transferred towards sub-assembly 7, rapid connection means being provided on the face 524*a* of the module 524 for supplying an internal chamber in which is disposed a valve 5241 similar to valve 5211 of a module 521. As before, displacement of valve 5241 against the effort generated by a spring 5242 may be controlled by the actuator 718, the coating product then being able to flow from module 524 towards the sub-assembly 7 though an outlet orifice 5244 of module 524.

The different modules 521 and 524 are supported by an angle 529*a* forming the structure of part 529 and controlled by four jacks, of which only one appears in FIG. 5 with reference 530 and whose strokes are different, which makes it possible to obtain, for part 529 of unit 52, sixteen positions corresponding respectively to the positioning of each of the fourteen modules 521 and each of the two modules 524 opposite part 719 of the sub-assembly 7.

Blocks 527 and 527' and collector 526 are supported by a plate 531 mobile with respect to a reference bracket 532 under the action of the jack 5251, a reinforcement 533 allowing transmission of the effort generated by the jack 5251 to the plate 531 of unit 51.

To allow connection of the connector 525 on one of the modules 524, the angle 529*a* is provided with two notches 529*b* allowing access to the rear faces 524*a* of the modules 524.

Unit 52 comprises two modules 524, which make it possible to use one module 524 for the solvented coating products and the other module 524 for the hydrosoluble products.

Taking the foregoing into account, unit 52 being displaced in direction $X_{52}$ before the movement of the table in the direction of arrow $F_3$, this movement, visible between FIGS. 4 and 5, leads to a simultaneous abutment and connection of the sub-assembly 7 on units 51 and 52.

When the table 20 is in place in the position of FIG. 5 and therefore when the connection of the sub-assembly 7 with units 51 and 52 has been effected, a unit 30 for controlling the sub-assembly 7 which belongs to the station 10 is displaced in the direction of the sub-assembly 7 as represented by arrow $F_9$ in FIG. 1, this unit 30 being mounted on the upper face of sub-assembly 7 in place of segment 6*c*. Unit 30 makes it possible to control the sub-assembly 7 in place in area 11 pneumatically and/or electrically, i.e., inter alia, to displace the piston 8*b* of the reservoir 8, monitoring this displacement, to control the valves located in the sub-assembly 7, and to control the turbine of this sub-assembly.

A single unit 30, mobile vertically in the direction of arrow $F_9$ and in the opposite direction, therefore makes it possible to control sub-assembly 7 and sub-assembly 7' alternately.

As also follows from FIG. 1, a collector 31 located at the level of the median axis $X_{10}$ of the station 10 is displaced upwardly, as represented by arrow $F_{10}$, to cover the sub-assembly 7 from underneath and recover the products transiting via the sprayer during the cleaning/filling operations. This receptacle is advantageously equipped with nozzles for spraying cleaning product enabling the outer surface of the sub-assembly to be rinsed. It is connected, by an evacuation conduit 32, to a bleed (ot shown).

Figure 9:
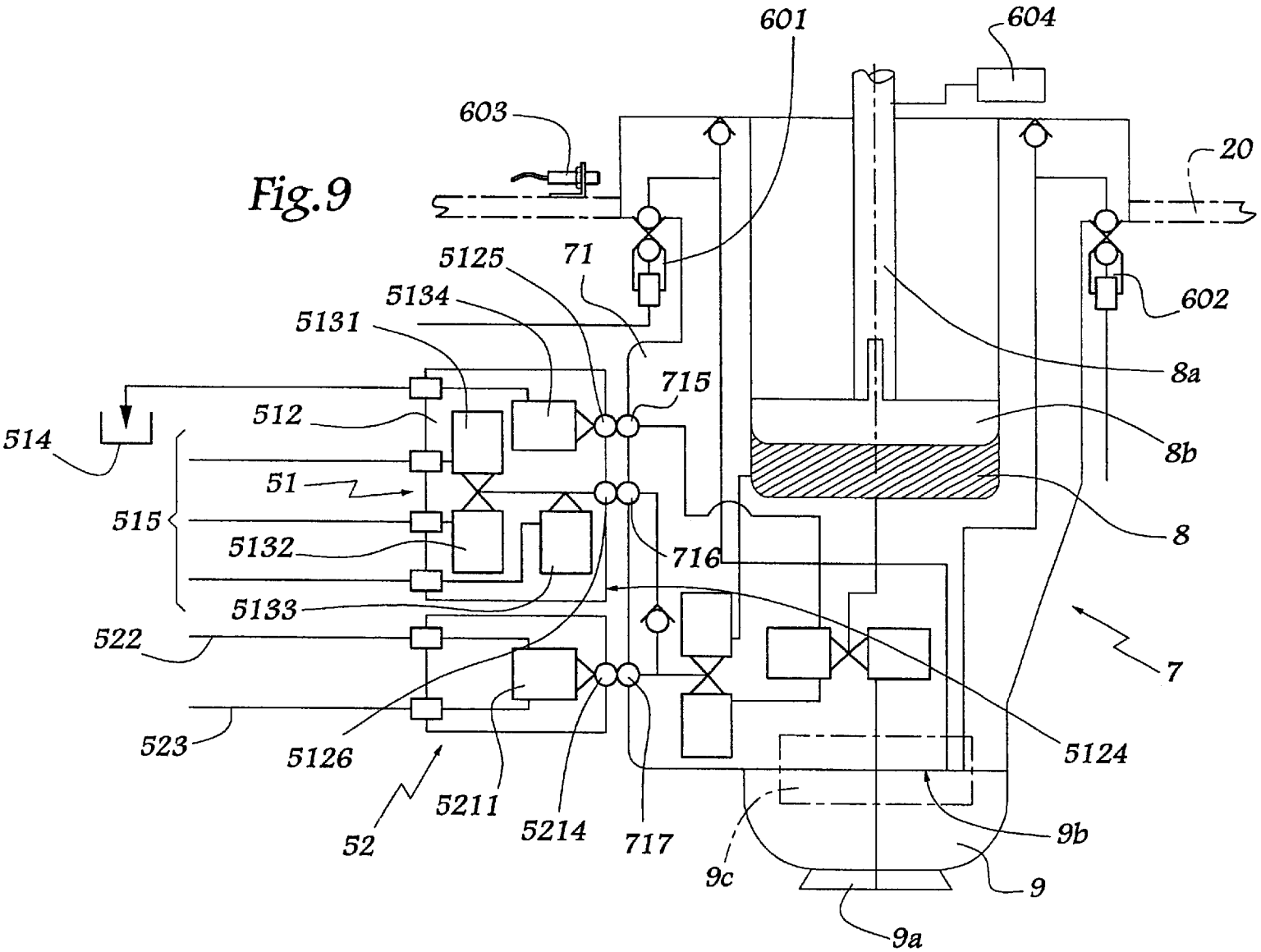

As follows more particularly from FIG. 9, two air supplies 601 and 602 are provided at the level of each area 11 or 12. These supplies 601 and 602 are intended to furnish air to the sub-assemblies 7 and 7' as soon as they are in position in the areas 11 and 12 and until they are withdrawn from these areas. A sensor 603 detects the presence of a sub-assembly 7 or 7' in one of the areas 11 or 12 and makes it possible to control the supplies 601 and 602 as a function of the presence of the sub-assemblies, which allows a saving of time in the cleaning/filling cycle. The air furnished by supply 601 is directed to the interior of the sub-assembly 7 or 7' up to a bearing 9*b* formed between a fixed part and a rotating part of a turbine 9*c*, while the air furnished by supply 602 is used for maintaining rotation of the turbine 9*c* of the sprayer 9 or 9' when the sub-assembly 7 or 7' is in place in area 11 or 12. In this way, the risks of squeezing or of blocking of the bearing 9*b* are avoided and the rotation of the turbine 9*c* and of the bowl 9*a* associated therewith is maintained, which allows an efficient evacuation of the cleaning product and of the coating product used for priming the sprayer on the one hand, and avoids a time for re-acceleration of the turbine 9*c*, which would be necessary if the rotation of the turbine were interrupted during the steps of cleaning and filling of the reservoir 8 and 8' and of the sprayer 9 or 9'.

In other words, as soon as the module 7 or 7' is mounted on the segment 6*c* of the robot 1, it is operational for spraying coating product without waiting for the corresponding turbine 9*c* to rotate.

According to an advantageous aspect, the speed of rotation of the turbine 9*c* when the sub-assembly 7 or 7' is in position in area 11 or 12, may be provided to be virtually identical to the speed of rotation used for spraying coating product.

The unit 30 also makes it possible to supply air to the sub-assembly 7 or 7', in particular to drive the turbine of the sub-assembly in question at a speed different from that obtained otherwise thanks to supply 601.

Filling of the reservoir 8 is controlled thanks, for example, to an encoder 604 connected to the rod 8*a* of the piston 8*b* of the reservoir 8. In effect, the displacement of the rod 8*a* is proportional to the quantity of product introduced in the reservoir 8.

The invention has been illustrated when the sub-assembly 7 is cleaned and filled. It is, of course, used when cleaning and filling the sub-assembly 7' while sub-assembly 7 is used for coating a body 3, the area 12 of the carriage 20 in that case being brought opposite the unit 51 then displaced by the table 21 up to its position of connection of the sub-assembly 7' with the units 51 and 52.

The order of the sequences of the process of the invention may be modified with respect to what has been described hereinbefore. However, the mobile part 529 of the unit 52 is preferably positioned, in the movement represented by arrow $F_6$, to bring the appropriate module 521 or 524 to the level of the median axis of the axis $X_{10}$ before the table 21 is displaced in the direction of arrow $F_3$ since a control unit of the station 10 makes it possible to anticipate knowing the coating product having to be used in a subsequent step of filling a sub-assembly 7 or 7'.

When a module 7 or 7' has been cleaned and filled, the table 21 is re-introduced into the booth C, through the opening 5*a* of the partition 5, which allows another sub-assembly to be deposited in the free area 11 or 12 and the module ready to paint to be taken by the robot 1.

The fact that the main part of the station 10 is installed outside the booth and that the cleaning and filling operations take place outside the booth, avoids the table 21 and the connection surfaces of the sub-assemblies 7 and 7' being soiled by the deposit of particles of paint not deposited on a body 3. This also facilitates maintenance of the station 10 during production.

According to a variant of the invention (not shown), the station 10 may be installed in a recess provided in the partition 5 and facing the interior of the spray booth. In that sense, the station 10 is located in the booth, but, for the main part, outside the area of activity of the robot 1. The table 21 is in that case displaced, perpendicularly to the axis of conveyance X—X', between a position where it is accessible by the robot 1, for the operations of deposit of a sub-assembly 7 or 7' in the corresponding area 11 or 12 and of connection of another assembly on the segment 6*c*, and a position inside the recess, i.e. outside the range of the robot, where the operations of connection, cleaning and/or filling take place. This recess may be accessible from outside the booth by means of doors or traps, which allows interventions on the station 10 while a body 3 is being coated The invention has been described with rotary sprayers 9 and 9'. However, it is applicable with pneumatic sprayers which may or may not be electrostatic. A station 10 of "mixed" type may be envisaged, adapted to receive sub-assemblies comprising both rotary and pneumatic sprayers.

Where the spray cycle time is shorter than the cleaning/filling cycle time, two cleaning/filling stations may be provided in the vicinity of a robot. Where the spray cycle time is more than twice the cleaning/filling cycle time, one cleaning/filling station may be provided for two adjacent robots, such a station in that case forming at least three sub-assembly receiving areas.

What is claimed is:

1. A process for changing product in an installation for spraying coating product, the installation comprising at least one robot adapted to displace a first sprayer opposite objects (3) to be coated, a first reservoir being associated with, and forming a first sub-assembly with, the first sprayer, said process comprising:

bringing the first reservoir towards an area of a cleaning/filling station, separating the first sub-assembly with respect to the robot, connecting a second sub-assembly, similar to the first sub-assembly, with the robot, the second sub-assembly being adapted to be used for spraying coating product during cleaning and/or filling of the first reservoir and the first sprayer, and cleaning and/or filling the first reservoir and the first sprayer in the area;

characterized in that said method further comprises:

positioning a coating product supply unit equipped with a plurality of outlets by displacing the unit in a first direction so that a predetermined outlet of the unit is disposed opposite the first sub-assembly; and displacing, in a second direction substantially perpendicular to said first direction, a structure defining at least two areas for receiving the first sub-assembly so as to reach a position of connection of the first sub-assembly with the coating product supply unit.

2. The process according to claim 1, characterized in that the operations of separating the first sub-assembly with respect to the robot and of connecting the second sub-assembly with the robot are effected within an area of activity of the robot, while the operations of cleaning and/or filling, positioning and displacing are effected outside the area of activity, by a movement of the structure in two orthogonal directions.

3. The process according to claim 1, characterized in that it further comprises a step of displacing the structure in the first direction so as to dispose one of the areas for receiving the first sub-assembly opposite a cleaning product supply unit, displacement of the structure in the second direction making it possible to reach a position of connection of the first sub-assembly with the cleaning product supply unit.

4. The process according to claim 1, characterized in that it further comprises connecting at least one of the units to one of the sub-assemblies received in one of the areas by displacement, in the second direction, of connection means provided on the first sub-assembly or in the cleaning/filling station.

5. The process according to claim 1, characterized in that it further comprises continuously supplying the first sub-assembly with air for forming a bearing and/or for driving a turbine of the first sprayer as soon as the first sub-assembly is deposited in a receiving area and until the first sub-assembly is withdrawn therefrom.

6. The process according to claim 5, characterized in that it further comprises continuously maintaining a turbine of the first sprayer in rotation during the steps of connecting, cleaning and/or filling and positioning.

7. A product changing station in an installation for spraying coating product, the installation comprising at least one robot, adapted to displace at least one sub-assembly composed of a sprayer and a reservoir opposite objects to be coated, said station comprising:

at least two areas for cleaning and/or filling said reservoir, each area adapted to receive the at least one of sub-assembly while that sub-assembly is disconnected from said robot; and means for cleaning and/or filling at least one of said reservoir and said sprayer of the at least one sub-assembly in each of the areas, characterized in that said areas are adapted to be brought into a position of connection of the at least one sub-assembly disposed in one of said areas with said cleaning and/or filling means, said cleaning and/or filling means comprise at least one unit, mobile in a first direction, provided with a plurality of outlets, and adapted to dispose a predetermined outlet of said unit in a position of connection to the at least one sub-assembly disposed in one of said areas.

8. The station according to claim 7, characterized in that said station comprises a structure defining said areas and a support with respect to which said structure is mobile in said first direction, said support being mobile with respect to said robot in a second direction substantially perpendicular to said first direction.

9. The station according to claim 7, characterized in that said cleaning and/or filling means comprise a first unit adapted to deliver to the at least one sub-assembly at least one cleaning fluid, said first unit being disposed opposite the at least one sub-assembly when the at least one sub-assembly is in the position of connection, and a second unit adapted to deliver to the at least one sub-assembly a predetermined coating product, said second unit being mobile with respect to said first unit.

10. The station according to claim 9, characterized in that said second unit comprises a plurality of modules supplied with coating product and adapted to be selectively connected to said sub-assembly, said modules being juxtaposed in a direction of displacement of said second unit.

11. The station according to claim 10, characterized in that at least one coating product is used most often and at least one other coating product is used less often, at least one of said modules is supplied by product circulation circuits, for the coating product used most often, and at least one other module is supplied from at least one coating product change block, with the coating products that is used less often.

12. The station according to claim 11, characterized in that another one of said modules is provided with means for connection to a connector supplied with coating product from said product change block, said connector being mobile in a direction substantially perpendicular to the direction of displacement of said second unit.

13. The station according to claim 7, characterized in that said cleaning and/or filling means comprise a mobile connection element movable in a direction toward the at least one sub-assembly for connection thereof.

14. The station according to claim 7, characterized in that said station further comprises means for supply air forming a bearing and/or for driving a turbine of the sprayer of the at least one sub-assembly as soon as the at least one sub-assembly is positioned in one of the areas.

15. The station according to claim 14, characterized in that said station further comprises a sensor detecting the presence of a sub-assembly in each of said areas.

* * * * *